US008708655B2

(12) United States Patent
Farris et al.

(10) Patent No.: US 8,708,655 B2
(45) Date of Patent: Apr. 29, 2014

(54) BLADE FOR A GAS TURBINE ENGINE

(75) Inventors: John R. Farris, Bolton, CT (US); Raymond Surace, Newington, CT (US)

(73) Assignee: United Technologies Corporation, Hartford, CT (US)

( * ) Notice: Subject to any disclaimer, the term of this patent is extended or adjusted under 35 U.S.C. 154(b) by 799 days.

(21) Appl. No.: 12/889,836

(22) Filed: Sep. 24, 2010

(65) Prior Publication Data

US 2012/0076661 A1 Mar. 29, 2012

(51) Int. Cl.
*F01D 5/14* (2006.01)

(52) U.S. Cl.
USPC ..... 416/179; 416/189; 416/190; 416/191; 416/223 R; 416/241 R

(58) Field of Classification Search
USPC ..... 416/179, 189, 190, 191, 223 R, 241 R
See application file for complete search history.

(56) References Cited

U.S. PATENT DOCUMENTS

| | | | | |
|---|---|---|---|---|
| 941,395 | A | | 11/1909 | Westinghouse |
| 1,057,423 | A | | 4/1913 | Haynes |
| 2,994,125 | A | | 8/1961 | Hansel, Jr |
| 3,696,500 | A | | 10/1972 | Tarshis et al. |
| 4,034,454 | A | | 7/1977 | Galasso et al. |
| 4,058,415 | A | | 11/1977 | Walter |
| 4,155,152 | A | | 5/1979 | Cretella et al. |
| 4,170,473 | A | | 10/1979 | Gerken |
| 4,241,110 | A | * | 12/1980 | Ueda et al. ..... 427/203 |
| 4,291,448 | A | | 9/1981 | Cretella et al. |
| 4,390,320 | A | | 6/1983 | Eiswerth |
| 4,437,913 | A | | 3/1984 | Fukui et al. |
| 4,477,226 | A | | 10/1984 | Carreno |
| 4,624,860 | A | | 11/1986 | Alber et al. |
| 4,671,735 | A | | 6/1987 | Rossmann et al. |
| 4,690,320 | A | | 9/1987 | Morishita et al. |
| 4,706,872 | A | | 11/1987 | Norris |
| 4,715,525 | A | | 12/1987 | Norris |
| 4,771,537 | A | | 9/1988 | Pryor et al. |
| 4,808,487 | A | * | 2/1989 | Gruenr ..... 428/610 |
| 4,814,236 | A | | 3/1989 | Qureshi et al. |
| 4,883,219 | A | | 11/1989 | Anderson et al. |
| 4,961,529 | A | | 10/1990 | Gottselig et al. |
| 4,978,051 | A | | 12/1990 | Tiearney, Jr. et al. |
| 5,242,758 | A | | 9/1993 | Hitchcock et al. |
| 5,316,599 | A | | 5/1994 | Ebato et al. |
| 5,323,954 | A | | 6/1994 | Shetty et al. |
| 5,422,072 | A | | 6/1995 | Mitsuhashi et al. |
| 5,609,286 | A | | 3/1997 | Anthon |
| 5,660,320 | A | | 8/1997 | Hoffmuller et al. |
| 5,683,226 | A | * | 11/1997 | Clark et al. ..... 415/200 |
| 5,690,469 | A | | 11/1997 | Deal et al. |
| 5,704,538 | A | | 1/1998 | Mittendorf |

(Continued)

FOREIGN PATENT DOCUMENTS

| | | |
|---|---|---|
| DE | 123702 | 9/1901 |
| DE | 837220 | 4/1952 |

(Continued)

*Primary Examiner* — Igor Kershteyn
(74) *Attorney, Agent, or Firm* — Carlson, Gaskey & Olds, P.C.

(57) ABSTRACT

A rotor blade for a turbine engine includes a first side that defines a first contact face with a hardcoat and a second side that defines a second contact face without a hardcoat.

16 Claims, 5 Drawing Sheets

(56) References Cited

U.S. PATENT DOCUMENTS

| | | | | |
|---|---|---|---|---|
| 5,890,274 | A | 4/1999 | Clement et al. | |
| 6,034,344 | A | 3/2000 | Ittleson et al. | |
| 6,164,916 | A | 12/2000 | Frost et al. | |
| 6,296,447 | B1 * | 10/2001 | Rigney et al. | 416/241 R |
| 6,345,955 | B1 * | 2/2002 | Heffron et al. | 415/115 |
| 6,465,040 | B2 * | 10/2002 | Gupta et al. | 427/142 |
| 6,485,678 | B1 | 11/2002 | Liang et al. | |
| 6,793,878 | B2 | 9/2004 | Blake et al. | |
| 6,860,718 | B2 * | 3/2005 | Suzuki et al. | 415/173.5 |
| 2005/0152805 | A1 | 7/2005 | Arnold et al. | |
| 2005/0241147 | A1 | 11/2005 | Arnold et al. | |

FOREIGN PATENT DOCUMENTS

| | | |
|---|---|---|
| EP | 0287371 | 10/1988 |
| EP | 0351948 | 1/1990 |
| GB | 733918 | 7/1955 |
| GB | 2135698 | 9/1984 |

* cited by examiner

BLADE FOR A GAS TURBINE ENGINE

STATEMENT REGARDING FEDERALLY SPONSORED RESEARCH OR DEVELOPMENT

This disclosure was made with Government support under N00019-02-C-3003 awarded by The United States Navy. The Government has certain rights in this invention.

BACKGROUND

The present disclosure relates to a gas turbine engine, and more particularly to a blade thereof.

Gas turbine engines often include a multiple of rotor assemblies within a fan section, compressor section and turbine section. Each rotor assembly has a multitude of blades attached about a rotor disk. Each blade includes a root section that attaches to the rotor disk, a platform section, and an airfoil section that extends radially outwardly from the platform section. The airfoil section may include a shroud which interfaces with adjacent blades. In some instances, galling may occur on the mating faces of each blade shroud caused by blade deflections due to vibration.

SUMMARY

A rotor blade for a turbine engine according to an exemplary aspect of the present disclosure includes a first side that defines a first contact face with a hardcoat and a second side that defines a second contact face without a hardcoat.

A rotor assembly for a turbine engine according to an exemplary aspect of the present disclosure includes a plurality of adjacent blades, a first of said plurality of adjacent blades having a hardcoat on a first contact face in contact with a second contact face without a hardcoat on a second of the plurality of adjacent blades.

A method of manufacturing a rotor blade according to an exemplary aspect of the present disclosure includes hardcoating only one contact face of a rotor blade having a first side that defines a first contact face and a second side that defines a second contact face.

BRIEF DESCRIPTION OF THE DRAWINGS

The various features and advantages of this disclosure will become apparent to those skilled in the art from the following detailed description of the disclosed non-limiting embodiment. The drawings that accompany the detailed description can be briefly described as follows.

DETAILED DESCRIPTION

Figure 1:
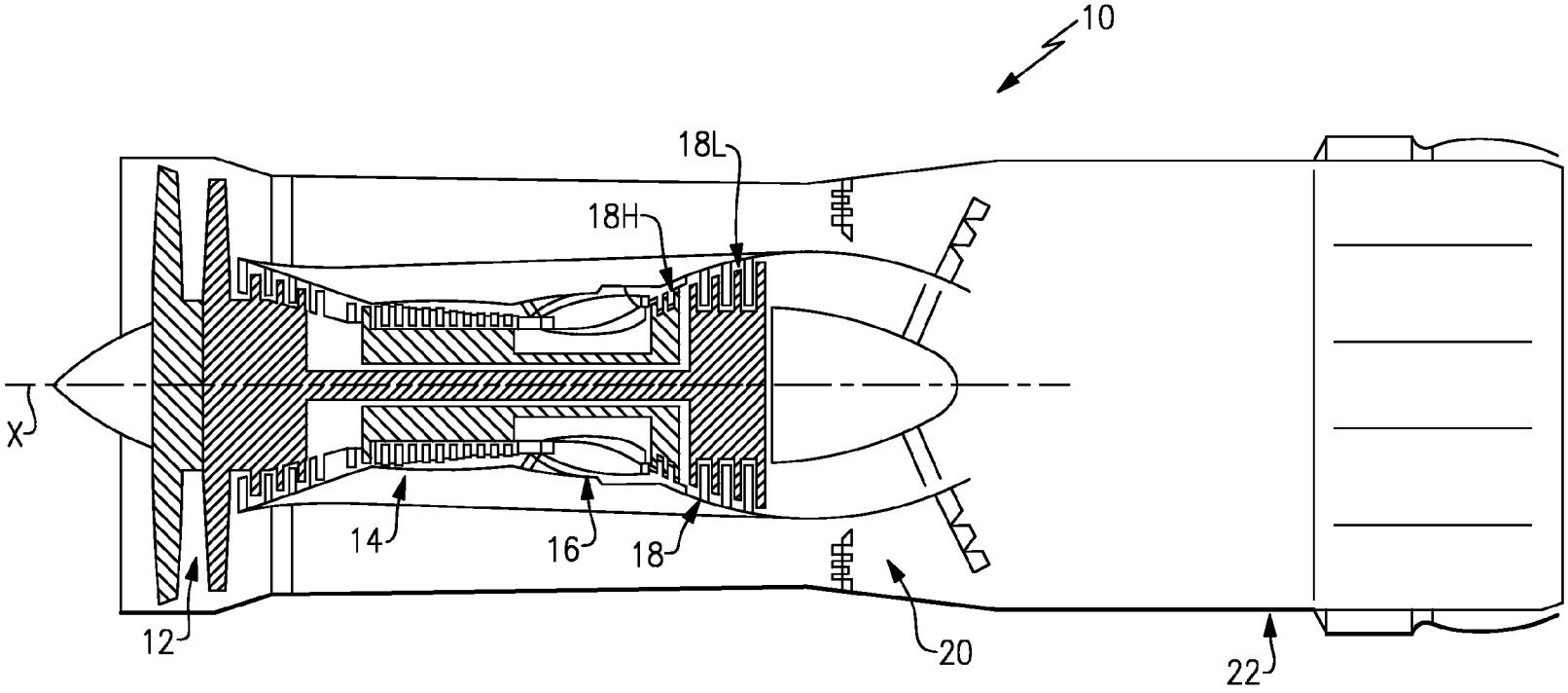
FIG. 1 is a schematic illustration of a gas turbine engine.

FIG. 1 schematically illustrates a gas turbine engine 10 which generally includes a fan section 12, a compressor section 14, a combustor section 16, a turbine section 18, an augmentor section 20, and an exhaust duct assembly 22. The compressor section 14, combustor section 16, and turbine section 18 are generally referred to as the core engine. An engine longitudinal axis X is centrally disposed and extends longitudinally through these sections. While a particular gas turbine engine is schematically illustrated in the disclosed non-limiting embodiment, it should be understood that the disclosure is applicable to other gas turbine engine configurations, including, for example, gas turbines for power generation, turbojet engines, high bypass turbofan engines, low bypass turbofan engines, turboshaft engines, etc.

The turbine section 18 may include, for example, a High Pressure Turbine (HPT), a Low Pressure Turbine (LPT) and a Power Turbine (PT). It should be understood that various numbers of stages and cooling paths therefore may be provided.

Figure 2:
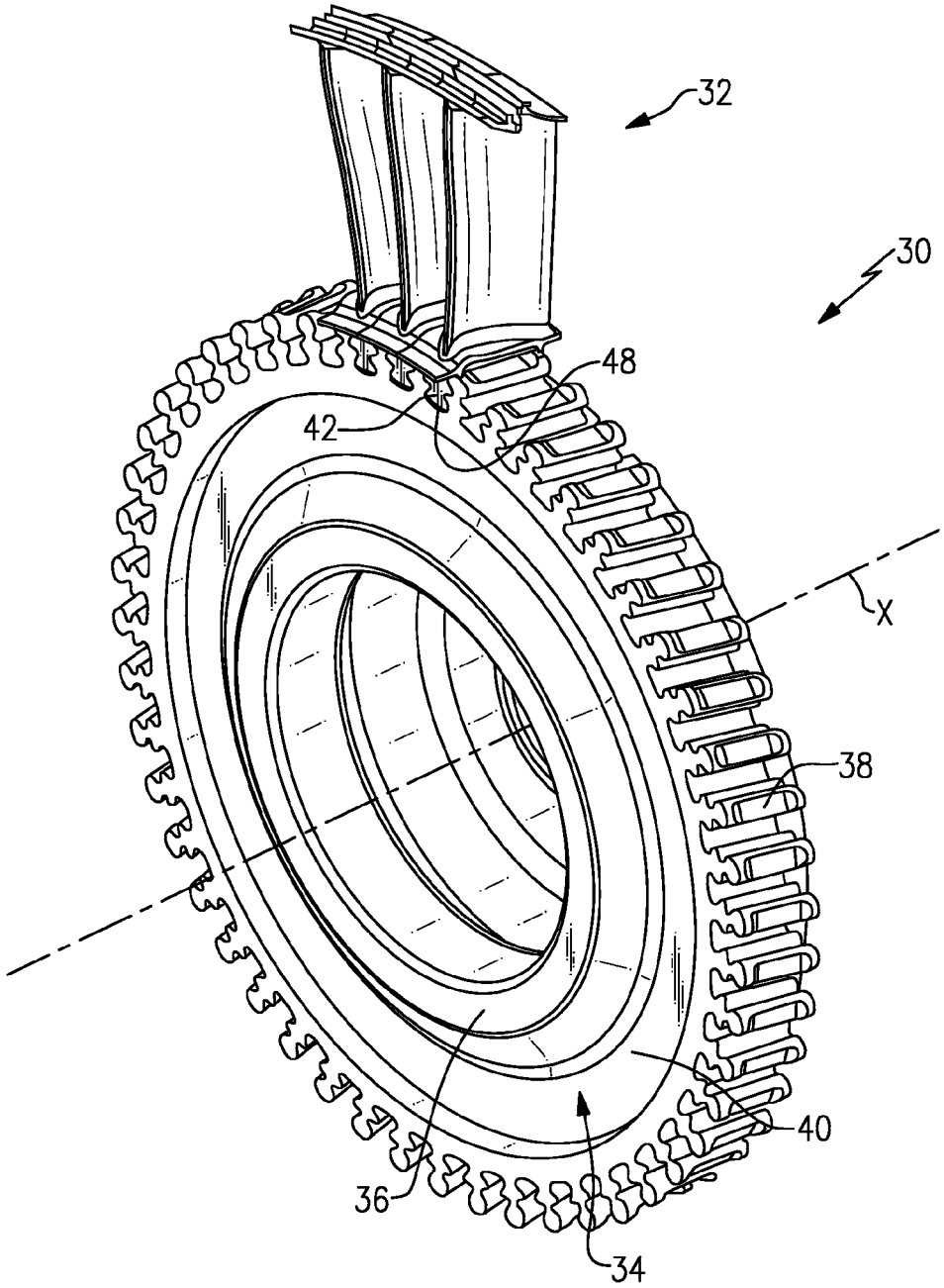
FIG. 2 is a general perspective view of a disk assembly form a turbine sectional view of a gas turbine engine.

Referring to FIG. 2, a rotor assembly 30 such as that of a stage of the LPT is illustrated. The rotor assembly 30 includes a plurality of blades 32 circumferentially disposed around a respective rotor disk 34. The rotor disk 34 generally includes a hub 36, a rim 38, and a web 40 which extends therebetween. It should be understood that a multiple of disks may be contained within each engine section and that although one blade from the LPT section is illustrated and described in the disclosed embodiment, other sections will also benefit herefrom. Although a particular rotor assembly 30 is illustrated and described in the disclosed embodiment, other sections which have other blades such as fan blades, low pressure compressor blades, high pressure compressor blades, high pressure turbine blades, low pressure turbine blades, and power turbine blades may also benefit herefrom.

Figure 3:
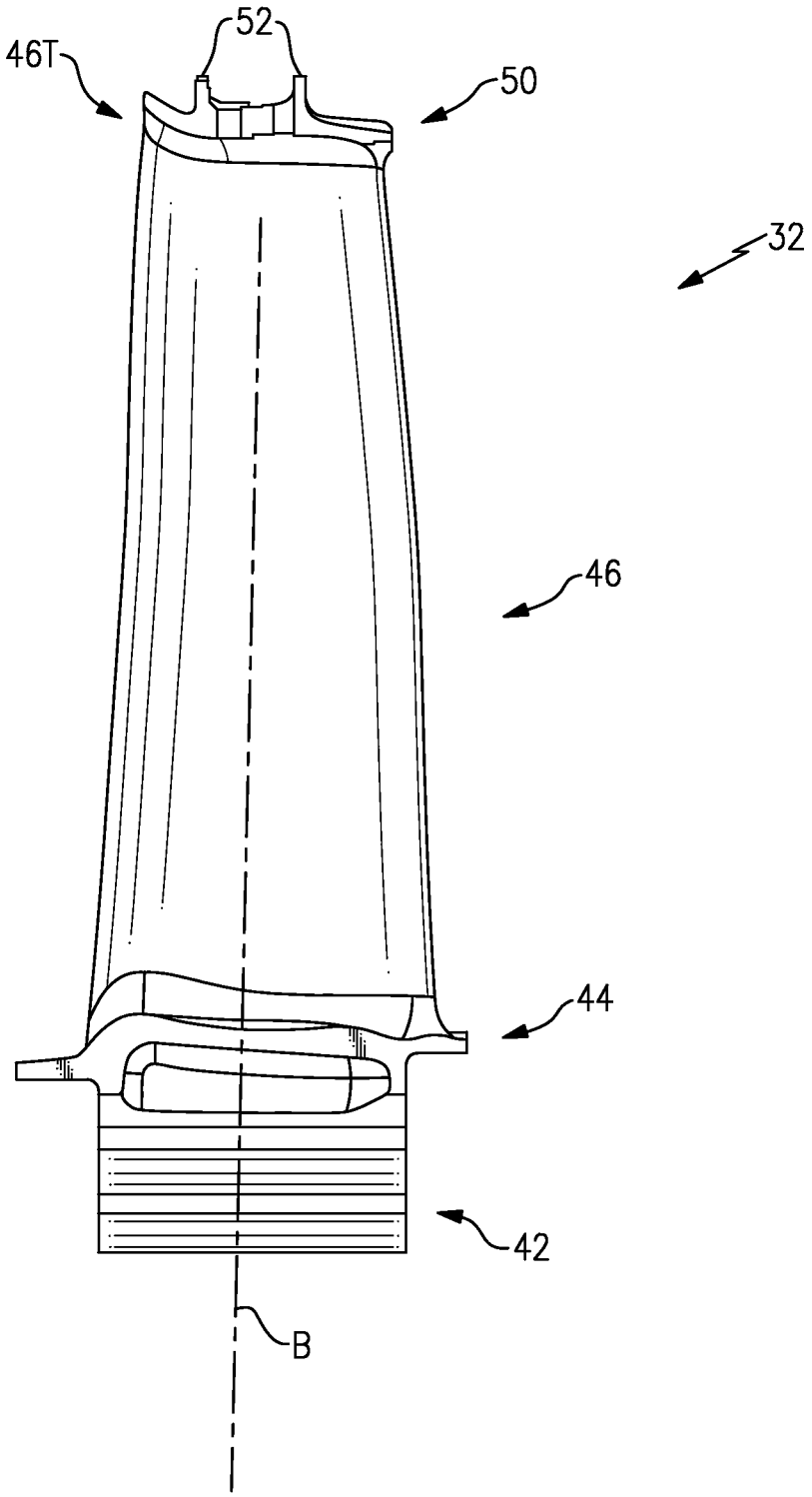
FIG. 3 is a side view of a shrouded turbine blade.

With reference to FIG. 3, each blade 32 generally includes an attachment section 42, a platform section 44, and an airfoil section 46 along a blade axis B. Each of the blades 32 is received within a blade retention slot 48 formed within the rim 38 of the rotor disk 34. The blade retention slot 48 includes a contour such as a dove-tail, fir-tree or bulb type which corresponds with a contour of the attachment section 42 to provide engagement therewith. The airfoil section 46 defines a pressure side 46P (FIG. 5) and a suction side 46S (FIG. 4).

Figure 6:
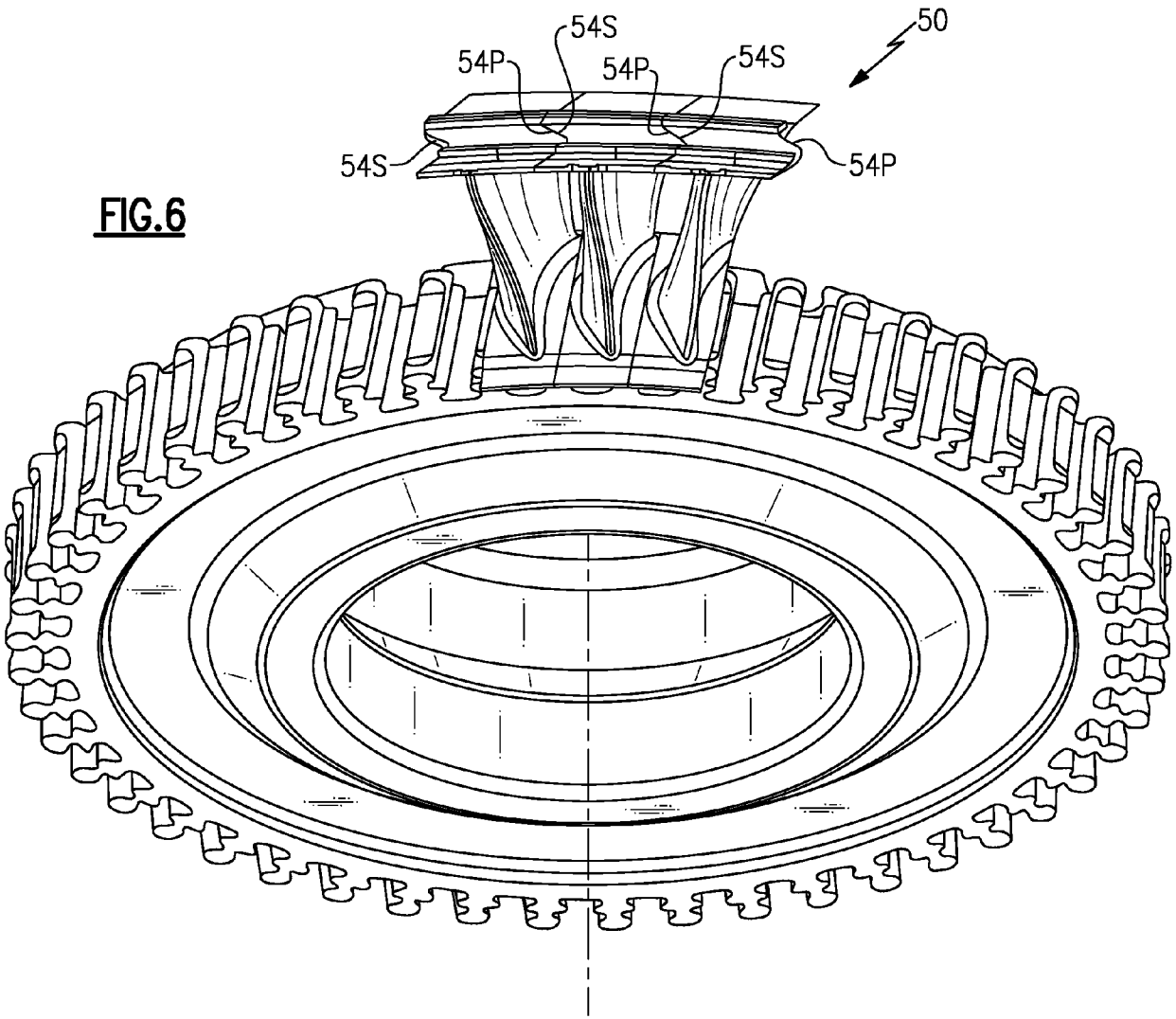
FIG. 6 is a perspective view of the disk assembly and three turbine blade shrouds.

A distal end section 46T includes a tip shroud 50 that may include rails 52 which define knife edge seals which interface with stationary engine structure (not shown). The rails 52 define annular knife seals when assembled to the rotor disk 34 (FIG. 6; with three adjacent blades shown). That is, the tip shroud 50 on one blade 32 interfaces with the tip shroud 50 on an adjacent blade 32 to form an annular turbine ring tip shroud.

Figure 4:
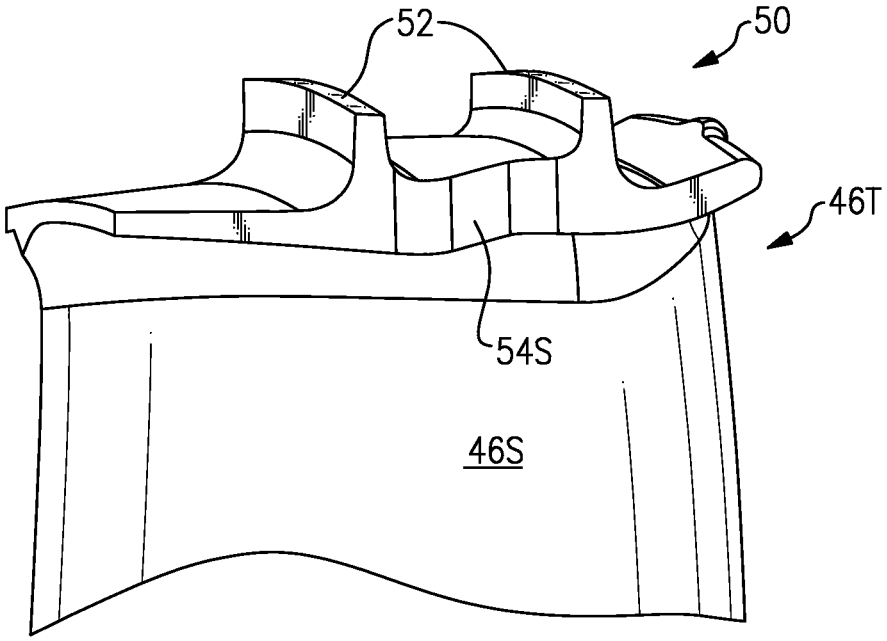
FIG. 4 is a suction side perspective view of the shrouded turbine blade.
Figure 5:
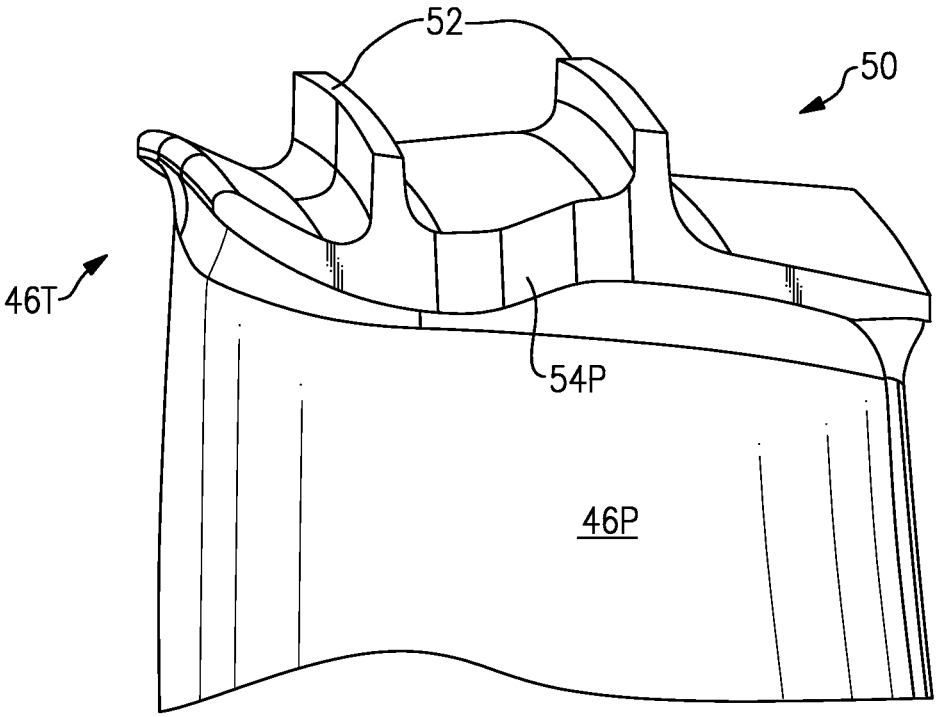
FIG. 5 is a pressure side perspective view of the shrouded turbine blade.

With reference to FIGS. 4 and 5, each tip shroud 50 includes a suction side shroud contact face 54S and a pressure side shroud contact face 54P. The suction side shroud contact face 54S on each blade contacts the pressure side shroud contact face 54P on an adjacent blade when assembled to the rotor disk 34 to form the annular turbine ring tip shroud (FIG. 2).

In one non limiting embodiment, the blade 32 is manufactured of a single crystal superalloy with one of either the suction side shroud contact face 54S or the pressure side shroud contact face 54P having a hardface coating such as a laser deposited cobalt based hardcoat. That is, the hardface coating contacts the non-hardface coating in a shroud contact region defined by the suction side shroud contact face 54S and the corresponding pressure side shroud contact face 54P between each blade 32 on the rotor disk 34. The suction side shroud contact face 54S or the pressure side shroud contact face 54P to which the hardface coating is applied may be ground prior to application of the hardface deposition or weld to prepare the surface and then finish ground after the application of the hardface to maintain a desired shroud tightness within the annular turbine ring tip shroud.

By reducing wear on the mating surfaces of a blade shroud, there is an increase in the functional life of the blade due to consistent blade damping. Applicant has determined that contact of dissimilar metals reduces wear and engine test confirmed less wear as compared to base metal on base metal and hardface coat on hardface coat interfaces. This is in contrast to conventional understanding of shroud contact faces in which each contact face is generally of the same material.

It should be understood that although a tip shroud contact interface is illustrated in the disclosed non-limiting embodiment, other contact interfaces such as a partial span shroud will also benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Many modifications and variations are possible in light of the above teachings. Non-limiting embodiments are disclosed herein, however, one of ordinary skill in the art would recognize that certain modifications would come within the scope of this disclosure. It is, therefore, to be understood that within the scope of the appended claims, the disclosure may be practiced otherwise than as specifically described. For that reason the following claims should be studied to determine the true scope and content of this disclosure.

What is claimed is:

1. A rotor blade for a turbine engine comprising:

an airfoil section;

a shroud annular section segment extending from one end of said airfoil section, said shroud annular section segment including a first circumferentially-facing side and an opposed second circumferentially-facing side, said first circumferentially-facing side including a hardcoat and said second circumferentially-facing side excluding a hardcoat.

2. A rotor blade for a turbine engine, comprising:

a platform section;

a root section which extends from said platform section;

an airfoil section which extends from said platform section opposite said root section; and a shroud section which extends from said airfoil section, said shroud section including a first side that defines a first contact face with a hardcoat and a second side that defines a second contact face without a hardcoat.

3. The rotor blade as recited in claim 2, wherein said shroud extends from a distal end of said airfoil section.

4. The rotor blade as recited in claim 3, wherein said airfoil is a turbine airfoil.

5. The rotor blade as recited in claim 2, wherein said second contact face without said hardcoat is manufactured of a nickel alloy.

6. The rotor blade as recited in claim 2, wherein said first contact face with said hardcoat is manufactured of a nickel alloy with a welded cobalt based hardcoat.

7. The rotor blade as recited in claim 2, wherein said first contact face with said hardcoat is manufactured of a nickel alloy with a laser deposited cobalt based hardcoat.

8. A rotor assembly for a turbine engine comprising:

a plurality of blades mounted in a circumferential arrangement, each of said blades including a first face and an opposed second face said first face including a hardcoat and said second face excluding a hardcoat, said hardcoat of said first face of each of said blades being in contact against said second face of an adjacent one of said blades.

9. A rotor assembly for a gas turbine engine, comprising;

a plurality of adjacent blades, a first of said plurality of adjacent blades having a hardcoat on a first contact face in contact with a second contact face without a hardcoat on a second of said plurality of adjacent blades, wherein each of said plurality of adjacent blades includes said first contact face and said second contact face, and wherein said first contact face and said second contact face are defined on a shroud section of each of said plurality of adjacent blades.

10. The rotor assembly as recited in claim 9, wherein said second contact face without said hardcoat is manufactured of a nickel alloy.

11. The rotor assembly as recited in claim 9, wherein said second contact face without said hardcoat is a base alloy of said plurality of adjacent blades.

12. A method of manufacturing a rotor blade comprising:

hardcoating only one contact face of a rotor blade having a first side that defines a first contact face on a shroud of said rotor blade and a second side that defines a second contact face on said shroud.

13. The method as recited in claim 12, further comprising:

grinding the one contact face which receives the hardcoating prior to the application of the hardcoat.

14. The method as recited in claim 12, further comprising:

grinding the one contact face which receives the hardcoating after application of the hardcoat.

15. The rotor blade as recited in claim 1, wherein said hardcoat is a cobalt-based material.

16. The rotor assembly as recited in claim 8, wherein said hardcoat is a cobalt-based material.

* * * * *